US006289307B1

(12) United States Patent
Aoyagi

(10) Patent No.: US 6,289,307 B1
(45) Date of Patent: Sep. 11, 2001

(54) CODEBOOK PRELIMINARY SELECTION DEVICE AND METHOD, AND STORAGE MEDIUM STORING CODEBOOK PRELIMINARY SELECTION PROGRAM

(75) Inventor: Hiromi Aoyagi, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 09/199,462

(22) Filed: Nov. 25, 1998

(30) Foreign Application Priority Data

Nov. 28, 1997 (JP) ..... 9-343839

(51) Int. Cl.[7] ..... G10L 19/00
(52) U.S. Cl. ..... 704/222; 704/219; 704/220
(58) Field of Search ..... 704/219, 220, 704/221, 222, 252, 223

(56) References Cited

U.S. PATENT DOCUMENTS

| | | | | |
|---|---|---|---|---|
| Re. 36,646 | * | 4/2000 | Akamine et al. | 704/223 |
| 5,677,986 | * | 10/1997 | Amada et al. | 704/222 |
| 5,774,838 | * | 6/1998 | Miseki et al. | 704/222 |
| 5,920,832 | * | 7/1999 | Wuppermann et al. | 704/219 |
| 6,041,297 | * | 3/2000 | Goldberg | 704/219 |
| 6,055,496 | * | 4/2000 | Heidari et al. | 704/222 |

OTHER PUBLICATIONS

"Pitch Synchronous Innovation CELP (PSI–CELP)—PDC half–rate speech CODEC". Tomoyuki Ohya, Hirohito Suda and Toshio Miki, the Institute of Electronics, Information and Communication Engineers, Technical Report of IEICE, RCS93–78, 1993–11, pp. 63–70.

"5.6 kbits/s PSI–CELP of the half–rate PDC speech coding standard". Tomoyuki Ohya, Hirohito Suda, Toshio Miki, NTT Mobile Communications Network Inc., 1994 IEEE 0–7803–1927–3/94, pp. 1680–1684.

* cited by examiner

*Primary Examiner*—Richemond Dorvil
*Assistant Examiner*—Angela Armstrong
(74) *Attorney, Agent, or Firm*—Rabin & Champagne, P.C.

(57) ABSTRACT

Prior to deriving precise evaluation values for evaluating errors between synthetic signal vectors and a target signal vector, simple evaluation values are derived. Based on the simple evaluation values, a given number of high-ranking candidates are preliminarily selected and then the precise evaluation values are derived with respect to the preliminarily selected candidates. For the preliminary selection of the candidates, the simple evaluation values are divided into as many groups as the number of the candidates to be preliminarily selected. Then, the simple evaluation values are mutually compared in each group to pick up the optimum value in each group.

5 Claims, 3 Drawing Sheets

Fig. 2

SYNTHETIC SIGNAL VECTOR: gHCi
TARGET SIGNAL VECTOR: T $$E_i = (T - gHC_i)^2 \quad \text{------- (1)}$$

$$E_i = T^tT - 2gT^tHC_i + g^2C_i{}^tH^tHC_i \quad \text{---------- (2)}$$

$$g = T^tHC_i / C_iH^tHC_i \quad \text{------- (3)}$$

$$E_i = T^tT - (T^tHC_i)^2 / C_i{}^tH^tHC_i \quad \text{---------- (4)}$$

$$e_i = (T^tHC_i)^2 = (VC_i)^2 \quad \text{------- (5)}$$

WHEREIN $V = T^tH$

CODEBOOK PRELIMINARY SELECTION DEVICE AND METHOD, AND STORAGE MEDIUM STORING CODEBOOK PRELIMINARY SELECTION PROGRAM

BACKGROUND OF THE INVENTION

1. Field of the Invention

The present invention relates to a codebook preliminary selection device, a codebook preliminary selection method and a storage medium storing a codebook preliminary selection program, for use in speech signal coding.

2. Description of the Related Art

In order to satisfy the requirements for increased capacity and reduced power consumption for mobile communication system, such as automobile telephone systems, standardization for low bit rate speech signal coding has been developed. The PSI-CELP (Pitch Synchronous Innovation-Code Excited Linear Prediction) is one of such well known standards. In PSI-CELP, 3.45 kbit/s is used for speech coding. In the speech coding, various processes, such as noise canceling, LSP quantization, power quantization, adaptive/fixed codebook searching and stochastic codebook searching, are carried out. This technique is introduced, for example, in the following literature:

Pitch Synchronous Innovation CELP (PSI-CELP)

—PDC half-rate speech CODEC—

Tomoyuki Ohya and collaborators

The Institute of Electronics, Information and Communication Engineers

Technical Report of IEICE, RCS93-78, 1993-11

In the PSI-CELP, vocal tract information and excitation source information are encoded separately and then multiplexed to form a total code for a speech signal. Specifically, for encoding an input speech signal, LPC (Linear Predictive Coding) is first performed to obtain LPC parameters (coefficients) which represent the vocal tract information. The excitation source information is encoded, for example, through vector quantization of LPC predictive errors and stored in codebooks, such as an adaptive codebook, in the form of excitation code vectors with corresponding indices. When encoding the excitation source information of the input speech signal, the adaptive codebook is searched in the following manner: Specifically, the code vectors stored in the adaptive codebook are selected individually and inputted into an LPC synthesis filter so as to obtain synthetic speech signals. The synthetic speech signals are compared with the input speech signal individually so that such a code vector that minimizes a perceptual error between the synthetic speech signal and the input speech signal is finally selected as optimally representing the excitation source information of the input speech signal.

In the foregoing technique, however, there has been the following problem:

Specifically, the foregoing codebook searching requires repetition of calculations using the input speech signal and a large number of excitation code vectors, thus resulting in enormous amounts of calculations. In view of this, the foregoing literature introduces a technique of preliminary selection so as to reduce the amount of calculations. In the preliminary selection technique, simple evaluation values for all the candidates (code vectors) stored in the codebook are derived and then high-ranking X candidates are selected based on these simple evaluation values. However, for selecting the high-ranking X candidates, calculations of comparison of approximately (all the candidates×X) times are required. This calculation amount is not negligible and impedes load reduction and increased speed of a processing unit.

SUMMARY OF THE INVENTION

Therefore, it is an object of the present invention to provide an improved codebook preliminary selection device.

It is another object of the present invention to provide an improved codebook preliminary selection method.

It is another object of the present invention to provide a storage medium storing an improved codebook preliminary selection program.

According to one aspect of the present invention, there is provided a codebook preliminary selection device comprising a synthesis filter that receives code vectors from a codebook and outputting synthetic signal vectors, respectively; a simple evaluation value deriving section that repeatedly executes matrix calculations based on a simplified calculation equation using an impulse response matrix of the synthesis filter, the code vectors from the codebook and gains of the code vectors inputted into the synthesis filter, so as to derive simple evaluation values, respectively, for evaluating errors between the synthetic signal vectors outputted from the synthesis filter and a target signal vector, respectively; a grouping section that divides the simple evaluation values into as many groups as the number of the simple evaluation values to be selected as candidates; and a preliminarily selecting section that compares the simple evaluation values mutually in each group to select the optimum value in each group and outputting the optimum values from all the groups as the candidates.

According to another aspect of the present invention, there is provided a codebook preliminary selection device comprising a synthesis filter receiving code vectors from a codebook and outputting synthetic signal vectors, respectively; a simple evaluation value deriving section repeatedly executing matrix calculations based on a simplified calculation equation using an impulse response matrix of the synthesis filter, the code vectors from the codebook and gains of the code vectors inputted into the synthesis filter, so as to derive simple evaluation values, respectively, for evaluating errors between the synthetic signal vectors outputted from the synthesis filter and a target signal vector, respectively; a grouping section dividing the simple evaluation values into as many groups as equal to or less than the number of the simple evaluation values to be selected as candidates; and a preliminarily selecting section comparing the simple evaluation values mutually in each group to select a given number of the high-ranking values in each group and outputting the high-ranking values from all the groups as the candidates.

It may be arranged that the given number of the high-ranking values is one when the number of the groups is equal to the number of the simple evaluation values to be selected, and more than one when the number of the groups is less than the number of the simple evaluation values to be selected.

According to another aspect of the present invention, there is provided a codebook preliminary selection method comprising the steps of, for evaluating errors between synthetic signal vectors outputted from a synthesis filter based on code vectors from a codebook and a target signal vector, respectively repeatedly executing matrix calculations based on a simplified calculation equation using an impulse response matrix of the synthesis filter, the code vectors from the codebook and gains of the code vectors inputted into the synthesis filter, so as to derive simple evaluation values, respectively; dividing the simple evaluation values into as many groups as equal to or less than the number of the simple evaluation values to be selected as candidates; and comparing the simple evaluation values mutually in each group to select a given number of the high-ranking values in each group and outputting the high-ranking values from all the groups as the candidates.

According to another aspect of the present invention, there is provided a storage medium that stores a program which is executable by a computer, the program allowing the computer to execute the steps of, for evaluating errors between synthetic signal vectors outputted from a synthesis filter based on code vectors from a codebook and a target signal vector, respectively, repeatedly executing matrix calculations based on a simplified calculation equation using an impulse response matrix of the synthesis filter, the code vectors from the codebook and gains of the code vectors inputted into the synthesis filter, so as to derive simple evaluation values, respectively; dividing the simple evaluation values into as many groups as equal to or less than the number of the simple evaluation values to be selected as candidates; and comparing the simple evaluation values mutually in each group to select a given number of the high-ranking values in each group and outputting the high-ranking values from all the groups as the candidates.

BRIEF DESCRIPTION OF THE DRAWINGS

The present invention will be understood more fully from the detailed description given hereinbelow, taken in conjunction with the accompanying drawings.

In the drawings:

FIG. 2 is an explanatory diagram for explaining an operation of a simple evaluation value deriving section of the device shown in FIG. 1.

DESCRIPTION OF THE PREFERRED EMBODIMENT

Now, a preferred embodiment of the present invention will be described hereinbelow with reference to the accompanying drawings.

Figure 1:
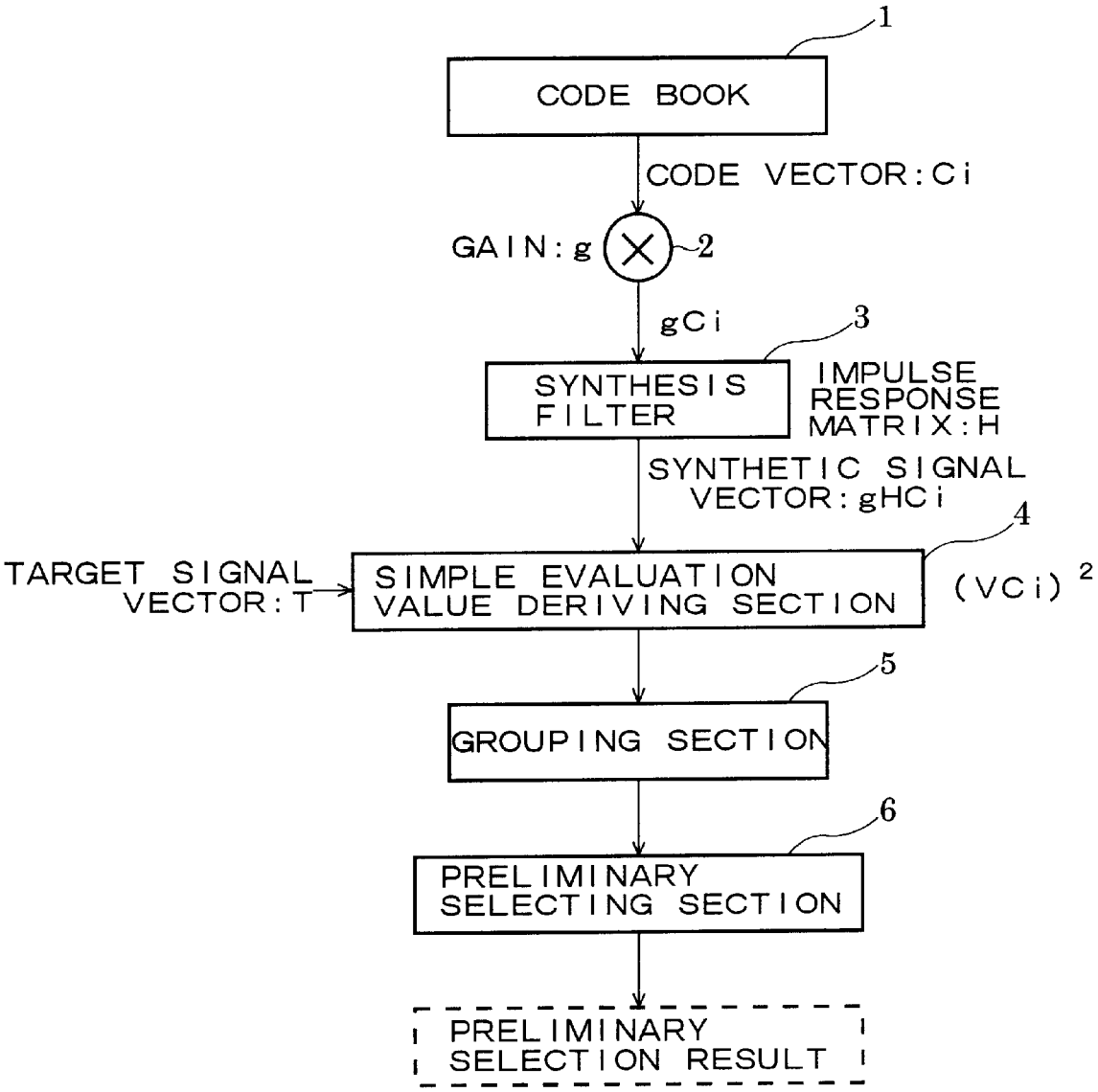
FIG. 1 is a block diagram showing a codebook preliminary selection device according to a preferred embodiment of the present invention.

FIG. 1 is a block diagram showing a codebook preliminary selection device according to the preferred embodiment of the present invention.

The device comprises a codebook 1, a multiplier 2, an LPC synthesis filter 3, a simple evaluation value deriving section 4, a grouping section 5 and a preliminary selecting section 6, which are connected in the order named. The codebook 1 may be an adaptive codebook known in the art that stores excitation code vectors Ci (i=1 to 128). The multiplier 2 multiplies the code vector Ci by a gain g for feeding to the synthesis filter 3. The multiplier 2 is a circuit for adjusting the level of a signal inputted into the synthesis filter 3. The synthesis filter 3 has an impulse response which is determined by a matrix H according to vocal tract parameters (LPC coefficients). Thus, a synthetic signal vector outputted from the synthesis filter 3 is given by gHCi.

In searching the codebook 1, one of the stored code vectors which minimizes a perceptual error between the synthetic signal vector gHCi outputted from the synthesis filter 3 and a target signal vector T derived from an input speech signal is finally selected. For simplifying calculation processes for such selection, the simple evaluation value deriving section 4 is provided.

FIG. 2 is an explanatory diagram for explaining an operation of the simple evaluation value deriving section 4.

As shown in FIG. 2, assuming that the synthetic signal vector and the target signal vector are represented by gHCi and T, respectively, an evaluation value Ei is given by squaring a difference between the vectors gHCi and T, as shown by equation (1) in FIG. 2. As appreciated, the final purpose is to obtain Ci which minimizes Ei. Equation (2) in FIG. 2 is obtained by expanding the equation (1). In the equation (2), t represents transposition and thus Ht represents a transposed matrix of a matrix H. Then, the equation (2) is subjected to partial differential with respect to g so as to derive an extreme value of Ei. Since the equation (2) is a quadratic function which is convex downward with respect to g, Ei takes a minimum value as an extreme value. The gain g at the minimum Ei is the optimum gain g which is given by an equation (3) in FIG. 2.

By substituting a right side of the equation (3) for g in the equation (2), an equation (4) in FIG. 2 is obtained. The equation (4) gives Ei at the optimum gain g. The first term of a right side of the equation (4) is constant regardless of values of i. On the other hand, as the second term of the right side of the equation (4) increases, Ei becomes smaller. As Ei becomes smaller, an error relative to the target signal vector is reduced. Accordingly, by obtaining the condition which gives the maximum value of the second term of the right side of the equation (4), Ci which provides the minimum error between the synthetic signal vector gHCi and the target signal vector T can be located.

However, the impulse response matrix H is in the form of matrix data and Ci takes 128 values. Therefore, the calculation of HCi requires 128 times matrix calculations and thus the enormous calculation amount is required for the whole term. In view of this, a simple evaluation value ei is used which is obtained by calculating only a numerator of the second term of the right side of the equation (4) as shown by an equation (5) in FIG. 2. According to the equation (5), the calculation amount is considerably reduced. The simple evaluation value deriving section 4 carries out the calculation given by the equation (5) so as to derive and output 128 simple evaluation values.

As appreciated, the foregoing processes up to deriving the 128 simple evaluation values are well known in the art.

In searching the codebook 1, a proper number of high-ranking candidates are preliminarily selected from among the 128 simple evaluation values derived by the simple evaluation value deriving section 4. Thereafter, the precise evaluation values Ei are derived for the selected candidates using the equation (4) in FIG. 2. Then, the code vector Ci which minimizes Ei is finally selected. The code vector Ci which maximizes the simple evaluation value ei does not always minimize the evaluation value Ei since the simple evaluation value ei contains a certain allowable error. In view of this, the proper number of the candidates are selected. By limiting the candidates, the calculation amount is considerably reduced as compared with the case wherein the calculation given by the equation (4) is carried out for all the code vectors Ci stored in the codebook 1.

If the high-ranking candidates are selected by comparing the 128 simple evaluation values one by one, the number of the comparison calculations amounts to approximately 128 the number of the candidates to be selected. Thus according to the preferred embodiment of the present invention, grouping is carried out relative to the simple evaluation values.

Figure 3:
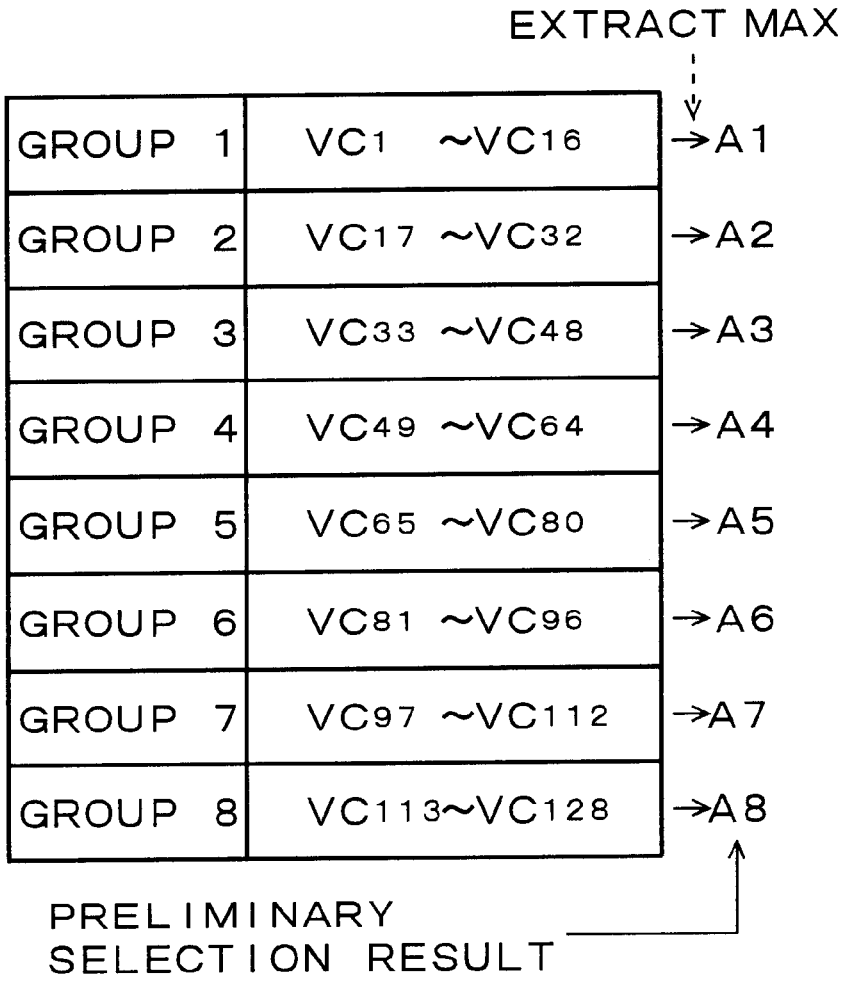
FIG. 3 is an explanatory diagram for explaining an operation of preliminary selection according to the preferred embodiment of the present invention.

FIG. 3 is an explanatory diagram for explaining an operation of preliminary selection of the candidates according to this embodiment.

It is assumed that 8 candidates are preliminarily selected. In this case, the 128 simple evaluation values outputted from the simple evaluation value deriving section 4 are divided into 8 groups at the grouping section 5. As shown in FIG. 3, each group includes 16 simple evaluation values.

Then, the preliminary selecting section 6 selects the maximum value among the 16 values in each group. Specifically, the 16 simple evaluation values in each group are mutually compared individually so that one of them, that is, the maximum value, is selected from each group. Thus, the simple evaluation values of 8 candidates A1 to A8 are selected in total and outputted as a preliminary selection result. The maximum value is selected in each group by picking up the simple evaluation values one by one at random for comparison with each other and then leaving the larger value. Accordingly, since each group includes 16 values, the maximum value in each group can be obtained through 15 times comparison calculations. Therefore, the number of times of comparison for all the groups is approximately the number of the groups×the number of the values in each group, that is, approximately the number of all the simple evaluation values. In contrast, in the conventional technique, the number of times of comparison becomes approximately the number of all the simple evaluation values×the number of the candidates to be selected. Thus, in this embodiment, the number of times of comparison can be reduced by approximately (1/the number of the candidates to be selected) as compared with the conventional technique.

As described above, according to this embodiment, the candidates can be preliminarily selected with the less calculation amount as compared with the conventional technique. Further, the probability is small that the large simple evaluation values are concentrated to one or some of the groups, so that essentially the high-ranking 8 candidates can be picked up.

In the foregoing embodiment, the number of candidates to be selected is set to be eight and the number of groups is also set to be eight. On the other hand, it may also be arranged that, for example, the number of groups is set to be four each including 32 simple evaluation values, and high-ranking two large values are selected from the 32 values in each group. The number of times of comparison for selecting the high-ranking 2 values from the 32 values is as small as 61 (31+30). That is, if the number of candidates to be selected in each group is small, the comparison times can be small enough to largely reduce the calculation load.

In the foregoing embodiment, the maximum value is selected from each group. However, a simple evaluation value can be taken out from the equation (4) in any desired manner so that a minimum value or another optimum value may be selected from each group.

The foregoing device can be wholly or partly constituted using the hardware. On the other hand, a program executable by a computer may be prepared corresponding to the operation of the foregoing device and stored in the computer so that such an operation is realized when the computer executes the stored program. The program may be stored in a storage medium, such as a CD-ROM or a flexible disk, and then installed into the computer.

As described above, according to the foregoing preferred embodiment of the present invention, prior to calculating the precise evaluation values for evaluating errors between the synthetic signal vectors and the target signal vector, the simple evaluation values are divided into as many groups as the number of the candidates to be preliminarily selected, and the optimum value is extracted in each group as a preliminarily selected candidate. Thus, the calculation process can be simplified and accelerated. It may also be arranged that the simple evaluation values are divided into a given number of groups and a plurality of high-ranking simple evaluation values are selected in each group as preliminarily selected candidates.

While the present invention has been described in terms of the preferred embodiment, the invention is not to be limited thereto, but can be embodied in various ways without departing from the principle of the invention as defined in the appended claims.

What is claimed is:

1. A codebook preliminary selection device, comprising:

a synthesis filter that receives code vectors from a codebook and outputs synthetic signal vectors, respectively;

a simple evaluation value deriving section that repeatedly executes matrix calculations based on a simplified calculation equation using an impulse response matrix of said synthesis filter, wherein the code vectors from said codebook and gains of the code vectors are inputted into said synthesis filter, so as to derive simple evaluation values, respectively, for evaluating errors between the synthetic signal vectors outputted from said synthesis filter and a target signal vector, respectively;

a grouping section that divides said simple evaluation values into as a number of groups equal to the number of said simple evaluation values to be selected as candidates; and a preliminary selecting section that compares said simple evaluation values mutually in each group to select an optimum value in each group and outputs the optimum values from all the groups as the candidates.

2. A codebook preliminary selection device, comprising:

a synthesis filter that receives code vectors from a codebook and outputting outputs synthetic signal vectors, respectively;

a simple evaluation value deriving section that repeatedly executes matrix calculations based on a simplified calculation equation using an impulse response matrix of said synthesis filter, wherein the code vectors from said codebook and gains of the code vectors are inputted into said synthesis filter, so as to derive simple evaluation values, respectively, for evaluating errors between the synthetic signal vectors outputted from said synthesis filter and a target signal vector, respectively;

a grouping section that divides said simple evaluation values into a number of groups equal or less than the number of said simple evaluation values to he selected as candidates; and a preliminary selecting section that compares the simple evaluation values mutually in each group to select a given number of the high-ranking values in each group and outputs the high-ranking values from all the groups as the candidates.

3. The codebook preliminary selection device according to claim 2, wherein said given number of the high-ranking values is one when the number of groups is equal to the number of the simple evaluation values to be selected, and is more than one when the number of the groups is less than the number of the simple evaluation values to be selected.

4. A codebook preliminary selection method, comprising the steps of:

for evaluating errors between synthetic signal vectors outputted from a synthesis filter based on code vectors from a codebook and a target signal vector, respectively, repeatedly executing matrix calculations based on a simplified calculation equation using an impulse response matrix of said synthesis filter, the code vectors from said codebook and gains of the code vectors inputted into said synthesis filter, so as to derive simple evaluation values, respectively;

dividing said simple evaluation values into a number of groups equal to or less than the number of the simple evaluation values to be selected as candidates; and comparing the simple evaluation values mutually in each group to select a given number of the high-ranking values in each group end outputting the high-ranking values from all the groups as the candidates.

5. A codebook preliminary selection method program which is executable by a computer, said program allowing said computer to execute the steps of:

for evaluating errors between synthetic signal vectors outputted from a synthesis filter based on code vectors from a codebook and a target signal vector, respectively, repeatedly executing matrix calculations based on a simplified calculation equation using an impulse response matrix of said synthesis filter, the code vectors from said codebook and gains of the code vectors inputted into said synthesis filter, so as to derive simple evaluation values, respectively;

dividing said simple evaluation values into a number of groups equal to or less than the number of the simple evaluation values to be selected as candidates; and comparing the simple evaluation values mutually in each group to select a given number of the high-ranking values in each group and outputting the high-ranking values from all the groups as the candidates.

* * * * *